US007291979B2

(12) United States Patent
Doll

(10) Patent No.: US 7,291,979 B2
(45) Date of Patent: Nov. 6, 2007

(54) DIELECTRIC BARRIER DISCHARGE LAMP HAVING DIVIDED ELECTRODES

(75) Inventor: Gerhard Doll, Guangzhou (CN)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 215 days.

(21) Appl. No.: 11/052,294

(22) Filed: Feb. 8, 2005

(65) Prior Publication Data

US 2005/0184639 A1 Aug. 25, 2005

(30) Foreign Application Priority Data

Feb. 23, 2004 (DE) ..... 10 2004 008 747

(51) Int. Cl.
*H01J 65/90* (2006.01)
*H01J 11/00* (2006.01)

(52) U.S. Cl. ..... 313/607; 313/234; 313/634

(58) Field of Classification Search ..... 313/607, 313/620–621, 632, 234, 633, 634; 315/219, 315/246, 276
See application file for complete search history.

(56) References Cited

U.S. PATENT DOCUMENTS 6,605,899 B2 8/2003 Berlinghof et al.
6,982,526 B2 * 1/2006 Schallmoser ..... 315/219
2002/0163306 A1 11/2002 Berlinghof et al.

* cited by examiner

*Primary Examiner*—Joseph L. Williams
(74) *Attorney, Agent, or Firm*—Robert F. Clark

(57) ABSTRACT

In the dielectric barrier discharge lamps according to the invention, the elongate, for example strip-like or linear, electrodes are each separated into two electrode elements (14*a*, 14*b*; 15*a*, 15*b*) by a gap in the longitudinal direction. This makes it possible, as intended, to operate one element (14*a*, 15*a*) of the electrode elements separately from the other element (14*b*, 15*b*) and, as a result, to cause either only one part of the lamp to illuminate or the entire lamp. For this purpose, one element (14*a*, 15*a*) of the electrode elements is connected to a first operating device (22), and the other element (14*b*, 15*b*) to a second operating device (21).

13 Claims, 2 Drawing Sheets

DIELECTRIC BARRIER DISCHARGE LAMP HAVING DIVIDED ELECTRODES

TECHNICAL FIELD

The invention is based on a dielectric barrier discharge lamp.

With this type of lamp the electrodes are separated from the discharge medium located in the interior of the discharge vessel by a dielectric. In this case, the electrodes can in principle either all be inside, all outside or the electrode(s) of one polarity inside and the other(s) outside the discharge vessel. For electrodes arranged outside the discharge vessel (also referred to below as outer electrodes), the wall of the discharge vessel acts as a dielectric barrier. If all of the electrodes are arranged inside the discharge vessel (also referred to below as inner electrodes), however, at least one electrode or the electrodes of one polarity need to be separated from the interior of the discharge vessel by a dielectric, for example by a dielectric coating. This dielectric barrier causes a so-called discharge which is dielectrically impeded on one side to be produced during operation. Alternatively, all of the electrodes may also be provided with a dielectric barrier. In this case, the discharge is dielectrically impeded on both sides. The latter also applies in particular to the case in which all of the electrodes are arranged outside the discharge vessel.

The invention relates in particular to dielectric barrier discharge lamps having a tubular discharge vessel. Such lamps are used, for example, in illumination units for copiers, scanners, fax machines and similar devices for office automation, so-called OA devices. However, other fields of application are also conceivable, for example in automobile technology, for example as an indicator light or brake light and for the internal illumination as well as for general illumination.

BACKGROUND ART

The specification U.S. Pat. No. 6,605,899 B2 has disclosed a tubular barrier discharge lamp having linear inner electrodes. The inner electrodes extend along the entire inner wall of the discharge tube and are passed to the outside in a gas-tight manner at one end. For this purpose, the discharge tube is sealed in a gas-tight manner at the end of the electrode bushings with the aid of a closure element in the form of a plate. For this purpose, the discharge tube is provided at this end with a constriction which annularly surrounds the edge of the closure element in the form of a plate. The constriction and the closure element in the form of a plate are then fused with one another in a gas-tight manner, the inner electrodes being passed through this seal to the outside.

Such lamps having different lengths are required in many applications, for example for scanner areas of different sizes. For example, there are devices which are suitable for documents having a size of up to A3 but also others which are suitable for up to A2 or even up to A0. For this purpose, in each case different lamps having a corresponding length are required. In order in this case to ensure the same illuminance for lamps of different lengths, a correspondingly matched operating device is required for each lamp length. Specifically it has been shown that the illuminance is approximately halved when a lamp is operated which has a length of approximately 650 mm using the same operating device that is designed for a lamp having a length of approximately 350 mm.

DISCLOSURE OF THE INVENTION

The object of the present invention is to provide a dielectric barrier discharge lamp having flexible potential applications. A further aspect is to provide solutions to illumination tasks, which relate to illumination areas having different extents given an essentially constant illuminance, using only one performance class of operating devices for such a dielectric barrier discharge lamp.

This object is achieved by a dielectric barrier discharge lamp having a discharge vessel, which surrounds a discharge space filled with a discharge medium, and elongate electrodes which extend essentially along the entire length of a longitudinal extent of the discharge space, each electrode being divided into two electrode elements in its longitudinal direction.

Particularly advantageous refinements are described in the dependent claims.

Also claimed are protection for the operation of the lamp according to the invention and an illumination system using the lamp according to the invention.

The invention provides for the elongate, for example strip-like or linear, electrodes used in generic dielectric barrier discharge lamps each to be separated into two electrode elements in the longitudinal direction. This makes it possible, as intended, to operate one element of the electrode elements separately from the other element and, as a result, to cause either only one part of the lamp, the complementary part or else the entire lamp to illuminate.

The elongate electrodes are preferably divided such that in each case the two electrode elements have the same length. Specifically, this has the advantage that two identical operating devices can be used to operate the two identical lamp halves, it being possible to achieve the same illuminance in each case with the two halves. It is thus possible, for example, for only one half of the lamp, which is preferably tubular for this purpose, to be switched on in a scanner when a small document format is exposed to light. With larger formats, however, the second half is also switched on. In both cases the illuminance is the same, as desired, for the documents of different sizes.

One basic prerequisite for the separate operation of the two elements of the electrode elements independently of one another is of course for the two electrode elements each to be electrically isolated from one another. A first element of the electrode elements is then connected to a first operating device, and the second element of the electrode elements to a second operating device. Reference is made to the second exemplary embodiment for more detailed explanations in this regard.

In one preferred embodiment of the invention, the dielectric barrier discharge lamp has a tubular discharge vessel, the electrode elements being oriented parallel to the longitudinal axis of the discharge vessel. The two respective corresponding electrode elements are preferably colinear, at least for the case of electrodes arranged on the inside of the wall of the discharge vessel. Specifically, this has the advantage that the two corresponding electrode elements can in each case be covered by a common, integrated web made of dielectric material, for example glass. In any case, in each case the two corresponding electrode elements are separated from one another by a gap, the length of the gap typically being in the range of between approximately 0.5 and 3 mm, preferably between approximately 0.5 and 2 mm, particularly preferably between approximately 0.5 and 1.5 mm. In this case, consideration should be taken of the fact that, on the one hand, the gap needs to be sufficiently large to ensure that the two electrode elements are completely electrically decoupled. On the other hand, the gap should not be too large since no discharge is provided there and this region of the lamp is thus not illuminated or is at least considerably darker.

BRIEF DESCRIPTION OF THE DRAWINGS

The invention will be explained in more detail below with reference to exemplary embodiments. In the figures.

BEST MODE FOR CARRYING OUT THE INVENTION

Figure 1A:
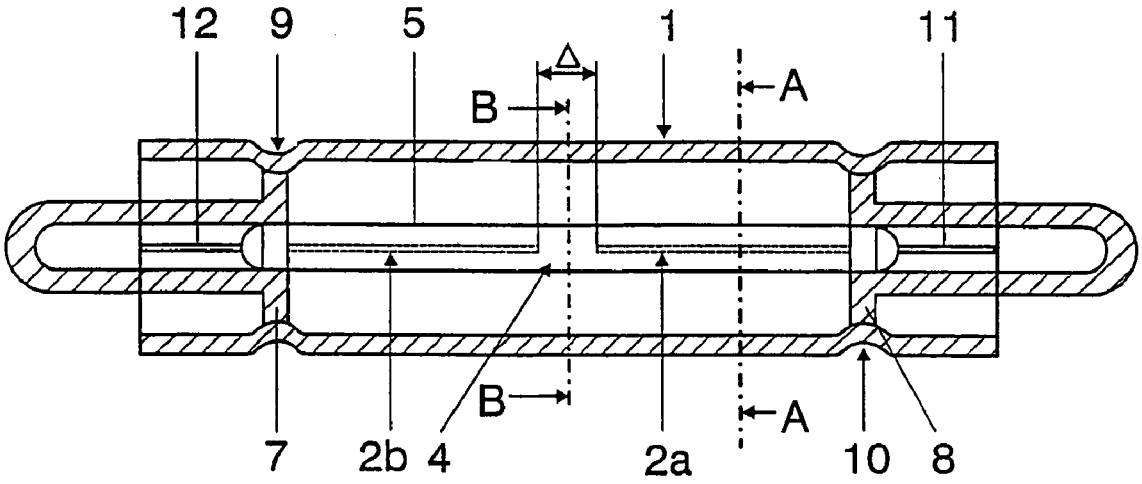
FIG. 1*a* shows a longitudinal section through a dielectric barrier discharge lamp according to the invention having inner electrodes.
Figure 1B:
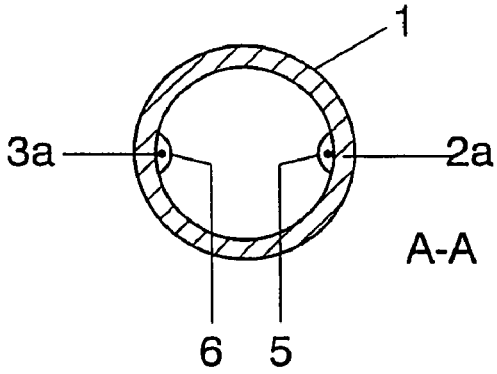
FIG. 1*b* shows a cross section through the lamp shown in FIG. 1*a* along the line AA.
Figure 1C:
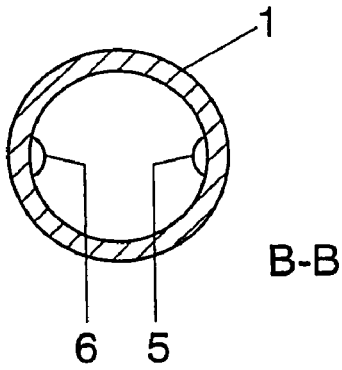
FIG. 1*c* shows a cross section through the lamp shown in FIG. 1*a* along the line BB.

FIGS. 1*a* to 1*c* show a longitudinal section, a cross section along the line AA and a cross section along the line BB of a dielectric barrier discharge lamp according to the invention. It has a tubular discharge vessel 1 and a total of four linear electrode elements 2*a*, 2*b* and 3*a*, 3*b*. In each case two electrode elements 2*a*, 2*b* or 3*a*, 3*b* are attached to the inside of the wall of the discharge vessel 1 in the form of silver webs which are approximately 1 mm wide such that they are oriented colinearly and parallel to the longitudinal axis of the tubular discharge vessel 1. In this case, the two halves of colinear electrode elements are arranged diametrically with respect to one another. The colinear electrode elements are separated by in each case a gap 4 (the second gap is not shown in the figures) whose longitudinal extent Δ is approximately 1 mm. It is thus possible for the diametrically opposite pairs of electrode elements 2*a*, 3*a* and 2*b*, 3*b* to be operated separately, i.e. only one of the two halves of the lamp is caused to illuminate or else both halves at the same time. The colinear electrode elements 2*a*, 2*b* and 3*a*, 3*b* are also each covered with a strip-like glass layer 5, 6 acting as a dielectric barrier, the two gaps 4 which each separate the two colinear electrode elements 2*a*, 2*b* and 3*a*, 3*b* from one another likewise being included (see FIG. 1*c*). The two ends of the tubular discharge vessel 1 are each sealed in a gas-tight manner which is free of connecting means by a closure element 7, 8 in the form of a plate. For this purpose, the discharge vessel 1 has a constriction 9, 10 at each end which annularly surrounds the edge of the respective closure element 7, 8 in the form of a plate and is fused. The electrode elements 2*a*, 3*a* and 2*b*, 3*b* are passed through the seal to the outside and act there as power supply lines 11, 12 (in the longitudinal section in FIG. 1*a* in each case only one power supply line can be seen per pair of electrodes). Reference is made to the abovementioned U.S. Pat. No. 6,605,899 B2 for further details on the closure technique for the tubular discharge vessel having dielectrically impeded inner electrodes. The discharge vessel 1 sealed in this way contains approximately 15 kPa of xenon as the discharge medium. Depending on the intended use, for example for OA applications, the inside of the wall of the discharge vessel may also be provided at least partially with fluorescent material (not illustrated) which converts the UV radiation produced during operation by the discharge medium into visible light.

Figure 2A:
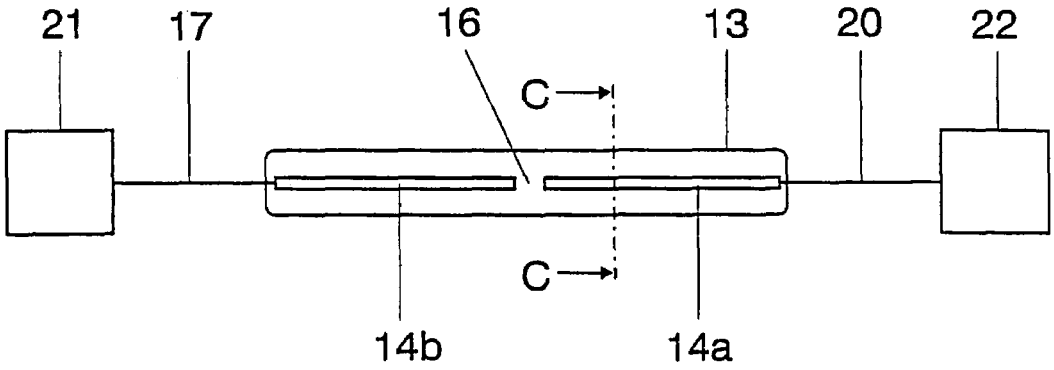
FIG. 2*a* shows a plan view of an illumination system according to the invention having a dielectric barrier discharge lamp having outer electrodes.
Figure 2B:
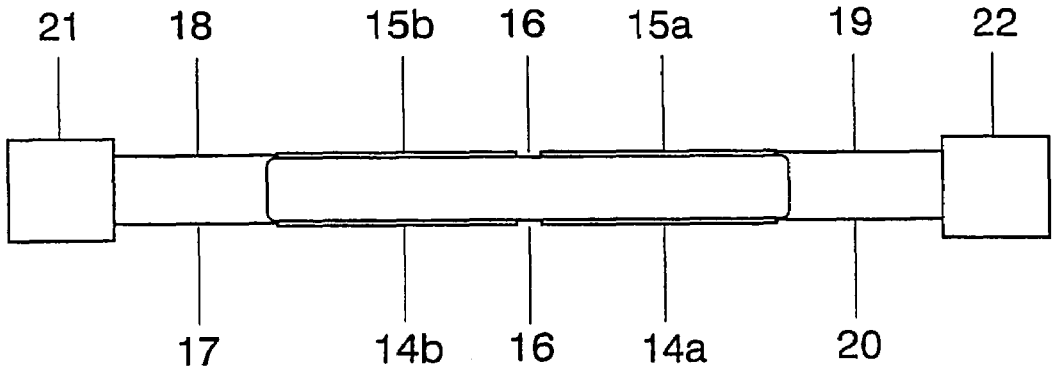
FIG. 2*b* shows a second plan view, rotated through 90° with respect to FIG. 2*a*, of the lamp.
Figure 2C:
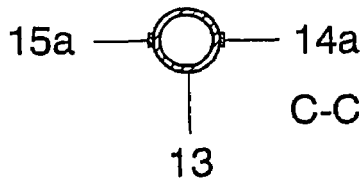
FIG. 2*c* shows a cross section through the lamp shown in FIG. 2*a* along the line CC.

FIGS. 2*a*, 2*b* and 2*c* show schematic illustrations of a first plan view, a second plan view, rotated through 90° with respect thereto, and a cross section along the line CC through a further exemplary embodiment. In this case, the illumination system is complete, having a tubular dielectric barrier discharge lamp, the latter having, however (in contrast to the previous exemplary embodiment), outer electrodes. For this purpose, four strip-like electrode elements 14*a*, 14*b*, 15*a*, 15*b* (the electrode elements 15*a*, 15*b* are not shown in FIG. 2*a*) are attached to the outside of the tubular discharge vessel 13. The arrangement of the electrode elements 14*a*, 14*b*, 15*a*, 15*b* including the two gaps 16 (in FIG. 2*a* the second gap is hidden) corresponds to that in the first exemplary embodiment. In addition, each pair of electrode elements 14*a*, 15*a* and 14*b*, 15*b* is connected to in each case an associated operating device 22, 21 via in each case two associated incoming lines 19, 20 and 17, 18, respectively (in each case the second incoming line 18, 19 cannot be seen in FIG. 2*a*).

Although the invention has been explained in more detail using the example of a tubular dielectric barrier discharge lamp, it is not restricted to this type of lamp. Instead, the invention also shows advantages when used in other types of lamps, in particular even in flat lamps. In flat dielectric barrier discharge lamps, the electrodes of each polarity generally have a comb structure. According to the invention, four such comb structures are thus used, in each case two "comb electrodes" being combined to form a pair of electrodes. Each of the two "pairs of comb electrodes" extends over a complementary part of the flat dielectric barrier discharge lamp. The two comb structures of each pair of comb electrodes can in this case be arranged on a common lamp vessel plate such that they engage with one another, or are positioned opposite one another on two opposing lamp vessel plates.

What is claimed is:

1. A dielectric barrier discharge lamp having a discharge vessel which surrounds a discharge space filled with a discharge medium and elongate electrodes which extend essentially along the entire length of a longitudinal extent of the discharge space, each electrode being divided into two electrode elements in its longitudinal direction.

2. The dielectric barrier discharge lamp as claimed in claim 1, in each case the two electrode elements having the same length.

3. The dielectric barrier discharge lamp as claimed in claim 1, in each case the two electrode elements being electrically isolated from one another.

4. The dielectric barrier discharge lamp as claimed in claim 1, the discharge vessel being tubular and the electrode elements being oriented parallel to the longitudinal axis of the discharge vessel.

5. The dielectric barrier discharge lamp as claimed in claim 1, in each case the two corresponding electrode elements being colinear.

6. The dielectric barrier discharge lamp as claimed in claim 5, in each case the two corresponding electrode elements being separated from one another by a gap.

7. The dielectric barrier discharge lamp as claimed in claim 6, the longitudinal extent of the gap lying in the range between approximately 0.5 and 3 mm.

8. The dielectric barrier discharge lamp as claimed in claim 5, the electrodes being arranged on the inside of the wall of the discharge vessel, and in each case the two corresponding electrode elements being covered by a common dielectric layer.

9. A method for operating a dielectric barrier discharge lamp having the features of claim 1, the two elements of the electrode elements being operated separately and electrically independently of one another.

10. An illumination system for carrying out the method as claimed in claim 9, a first element of the electrode elements being connected to a first operating device, and the second element of the electrode elements being connected to a second operating device.

11. The dielectric barrier discharge lamp as claimed in claim 2, in each case the two electrode elements being electrically isolated from one another.

12. The dielectric barrier discharge lamp as claimed in claim 6, the electrodes being arranged on the inside of the wall of the discharge vessel, and in each case the two corresponding electrode elements being covered by a common dielectric layer.

13. The dielectric barrier discharge lamp as claimed in claim 7, the electrodes being arranged on the inside of the wall of the discharge vessel, and in each case the two corresponding electrode elements being covered by a common dielectric layer.

* * * * *